US005529133A

United States Patent [19]

Eddison

[11] Patent Number: 5,529,133

[45] Date of Patent: Jun. 25, 1996

[54] STEERABLE DRILLING TOOL AND SYSTEM

[75] Inventor: Alan M. Eddison, Houston, Tex.

[73] Assignee: Schlumberger Technology Corporation, Sugar Land, Tex.

[21] Appl. No.: 430,000

[22] Filed: Apr. 27, 1995

Related U.S. Application Data

[62] Division of Ser. No. 286,291, Aug. 5, 1994.

[51] Int. Cl.[6] ..... E21B 7/08

[52] U.S. Cl. ..... 175/61

[58] Field of Search ..... 175/61, 62, 40, 175/41, 45, 46, 48, 50, 73–75

[56] References Cited

U.S. PATENT DOCUMENTS

| | | | |
|---|---|---|---|
| 3,637,032 | 1/1972 | Jeter . | |
| 4,040,494 | 8/1977 | Kellner . | |
| 4,291,773 | 9/1981 | Evans . | |
| 4,461,359 | 7/1984 | Jones, Jr. et al. . | |
| 4,637,479 | 1/1987 | Leising . | |
| 4,697,651 | 10/1987 | Dellinger | 175/61 |
| 4,714,118 | 12/1987 | Baker et al. . | |
| 4,732,223 | 3/1988 | Schoeffler et al. . | |
| 4,811,798 | 3/1989 | Falgout, Sr. et al. . | |
| 4,821,815 | 4/1989 | Baker et al. . | |
| 4,836,301 | 6/1989 | Van Dongen et al. . | |
| 4,858,705 | 8/1989 | Thiery . | |
| 4,867,255 | 9/1989 | Baker et al. . | |
| 4,895,214 | 1/1990 | Schoeffler . | |
| 4,995,465 | 2/1991 | Beck et al. . | |
| 5,103,919 | 4/1992 | Warren et al. | 175/61 X |
| 5,113,953 | 5/1992 | Noble . | |
| 5,139,094 | 8/1992 | Prevedel et al. | 175/61 |
| 5,163,521 | 11/1992 | Pustanyk et al. | 175/61 X |
| 5,220,963 | 6/1993 | Patton | 175/61 X |
| 5,265,682 | 11/1993 | Russell et al. . | |
| 5,305,830 | 4/1994 | Wittrisch . | |
| 5,305,858 | 4/1994 | Pauc . | |

FOREIGN PATENT DOCUMENTS

| | | |
|---|---|---|
| 2246151 | 1/1992 | United Kingdom . |

OTHER PUBLICATIONS

Anadrill Schlumberger Brochure, "Anadrill Tightens Directional Control with Downhole–Adjustable Stabilizers", no date.

*Primary Examiner*—Michael Powell Buiz
*Attorney, Agent, or Firm*—David L. Moseley; Wayne I. Kanak

[57] ABSTRACT

A steerable rotary drilling tool includes a drill bit mounted on the lower end of a housing by a drive shaft having an articulative coupling that allows the bit's rotation axis to be inclined relative to the rotation axis of the housing, an eccentric weight in the housing that maintains the bit axis pointed in only one direction in space as the bit is turned by the housing, and a clutch system that allows such direction to be changed downhole. A measuring-while-drilling tool is included to allow the progress of the drilling to be monitored at the surface, and to allow changing the bit axis or toolface by a selected amount.

4 Claims, 5 Drawing Sheets

STEERABLE DRILLING TOOL AND SYSTEM

This is a division of application Ser. No. 08/286,291, filed Aug. 5, 1994.

BACKGROUND OF THE INVENTION

1. Field of the Invention

This invention relates generally to tools and methods for drilling an inclined borehole using rotary drilling techniques, and particularly to rotary directional drilling tools and methods where the axis of rotation of the drill bit is articulated relative to the longitudinal axis of the lower end portion of the drill string in a manner which allows the bit to drill a steered, directional borehole in response to drill string rotation.

2. Description of the Related Art

An oil or gas well often has a subsurface section that is drilled directionally, that is a portion of the wellbore is inclined at an angle with respect to vertical and with the inclination having a particular compass heading or azimuth. Although wells having deviated sections may be drilled most anywhere, a large number of such wells are drilled offshore from a single production platform in a manner such that the bottoms of the boreholes are distributed over a large area of a producing horizon over which the platform is centrally located.

A typical procedure for drilling a directional borehole is to remove the drill string and bit by which the initial, vertical section of the well was drilled using conventional rotary techniques, and run in a mud motor having a bent housing at the lower end of the drill string which drives the bit in response to circulation of drilling fluids. The bent housing provides a bend angle such that the axis below the bend point, which corresponds to the rotation axis of the bit, has a "toolface" angle with respect to a reference, as viewed from above. The toolface angle, or simply "toolface", establishes the azimuth or compass heading at which the borehole will be drilled as the mud motor is operated. Once the toolface has been established by slowly rotating the drill string and observing the output of various orientation devices, the motor and bit are lowered to bottom and the mud pumps are started to cause the bit to be turned. The presence of the bend angle causes the bit to drill on a curve until a desired inclination has been built up. Then the drill string is rotated at the surface so that its rotation is superposed over that of the mud motor output shaft, which causes the bend point to merely orbit around the axis of the borehole so that the bit drills straight ahead at whatever inclination and azimuth have been established. If desired, the same directional drilling techniques can be used near total depth to curve the borehole back to the vertical and then extend it vertically down into or through the production zone. Measurement-while-drilling (MWD) systems commonly are included in the drill string above the motor to monitor the progress of the drilling so that corrective measures can be instituted if the various borehole parameters are not as planned.

However, when drilling is being done with a mud motor and the drill string is not being rotated, various problems can arise. The reactive torque due to operation of the motor and bit can cause the toolface to gradually change so that the borehole is not being deepened at the desired azimuth. If not corrected the wellbore may extend to a point that is too close to another wellbore, and be considerably longer than necessary. This of course will increase drilling costs substantially and reduce drainage efficiency. Moreover, a nonrotating drill string may cause increased frictional drag so that there is less control over weight-on-bit, and its rate of penetration, which also can result in substantially increased drilling costs. Of course a nonrotating drill string is more likely to get stuck in the wellbore than a rotating one, particularly where the string extends past a permeable zone where mud cake has built up.

A patent which is related to the field of this invention is Noble U.S. Pat. No. 5,113,953, which proposes contra-rotating the drill bit axis at a speed that is equal and opposite to the rotational speed of the drill string. Such contra-rotation is caused by an electric servo motor which drives an eccentric that engages a spigot or faucet on a bit drive shaft extension. The servo motor and a control unit therefor appear to be powered by a battery pack which includes sensors that are alleged to sense instantaneous azimuth or direction of a hypothetical reference radius of the tool. However, due to the electronic sophistication of this device it is unlikely to survive for very long in a hostile downhole drilling environment, so that its reliability may leave much to be desired.

An object of the present invention is to provide new and improved drilling tools and methods where the drilling of a directional wellbore can be accomplished while the drill string is being rotated.

Another object of the present invention is to provide new and improved drilling tools and methods for drilling a directional wellbore whereon the bit can be steered to stay on a desired course.

Still another object of the present invention is to provide new and improved drilling tools and methods where the rotation axis of the bit, or toolface, always points in one direction in space irrespective of the rotation of the drill string.

SUMMARY OF THE INVENTION

These and other objects are attained in accordance with the concepts of the present invention through the provision of a rotary drilling tool including a tubular housing connected to the drill string and carrying a drill bit on its lower end. The bit is connected to the housing by a shaft and a coupling that transmit torque while allowing the rotation axis of the bit to pivot universally to a limited degree relative to the longitudinal axis of the housing. The upper end of the bit drive shaft is coupled by means including an eccentric bearing to an eccentric weight around which the housing can rotate so that the weight remains stationary adjacent the low side of the borehole by reason of gravity. The eccentric bearing and the weight cause the longitudinal axis of the bit drive shaft to point in only one direction as the housing is rotated around it by the drill string.

In order to rotatively orient the tool so that the bit axis has a desired toolface, or to change such toolface after the drilling of a directional borehole has commenced, a clutch system responsive to mud flow and manipulation of the drill string is used. When mud circulation momentarily is stopped, a first clutch in the tool engages to lock the eccentric bearing against rotation relative to the housing. The extension of a telescoping joint at the upper end of the tool disengages a second clutch which allows the eccentric weight to remain on the low side of the hole, and opens up an additional mud flow path through the tool so that only minimal flow restriction is present. With the additional flow path open, mud circulation is started so that the tool can be oriented by slowly rotating the drill string and the housing, while observing at the surface the display of the MWD trammission of signals representing directional parameters downhole. When a desired toolface is obtained, the telescoping joint is closed to reengage the second clutch and close the additional flow path. Engagement of the second clutch causes the eccentric weight to maintain the rotation axis of the bit pointing in a single direction in space, and the resumption of mud flow through restricted passages releases the first clutch so that the housing can rotate freely around the eccentric bearing and weight in response to rotation of the drill string. Rotary drilling then can be commenced with the bit having a new toolface angle. Thus the drilling tool of the present invention can be steered using the above procedure any time that directional changes are needed.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which.

DESCRIPTION OF A PREFERRED EMBODIMENT

Figure 1:
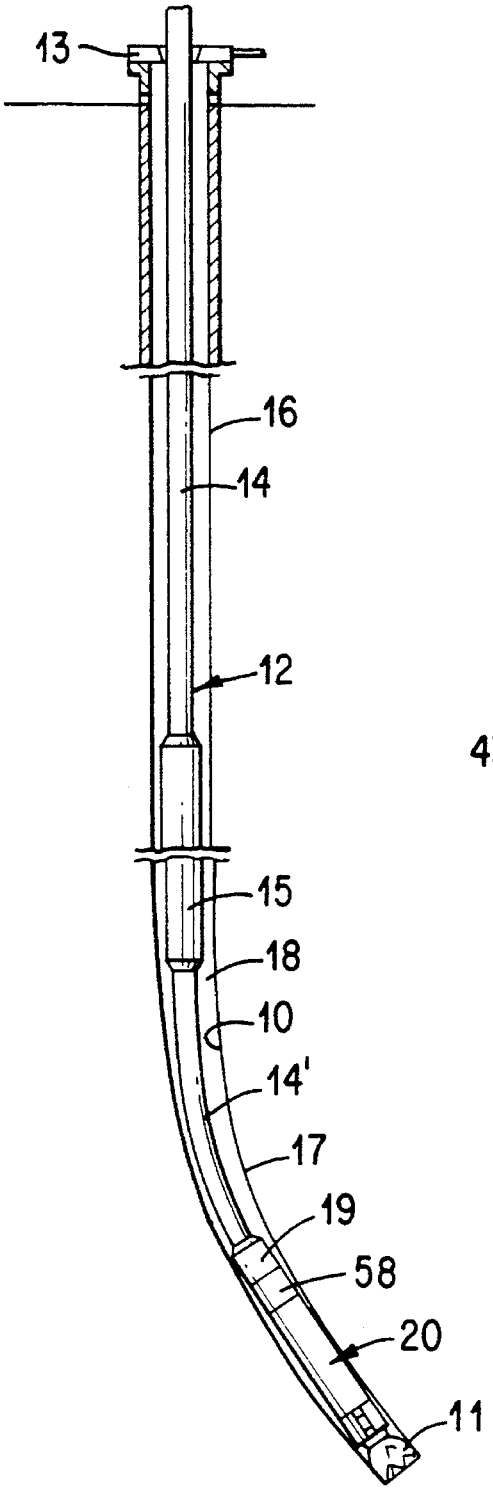
FIG. 1 is a schematic view of a well being drilled in accordance with the present invention.

Referring initially to FIG. 1, a wellbore 10 is shown being drilled by a bit 11 on the lower end of a drill string 12 that extends upward to the surface where it is mined by the rotary table 13 of a typical drilling rig (not shown). The drill string 12 usually includes drill pipe 14 that suspends a length of heavy drill collars 15 which apply weight to the bit 11. The wellbore 10 is shown as having a vertical or substantially vertical upper portion 16 and a curved lower portion 17 which is being drilled under the control of a drilling tool 20 that is constructed in accordance with the present invention. To provide the flexibility that is needed in the curved portion 17, a lower section of drill pipe 14' may be used to connect the collars 15 to the drilling tool 20 so that the collars remain in the vertical portion 16 of the wellbore 10. The lower hole portion 17 will have been kicked off from the vertical portion 16 in the usual fashion. The curved or inclined portion 17 then will have a low side and a high side, as will be readily appreciated by those skilled in the art. In accordance with usual practice, drilling fluid or "mud" is circulated by surface pumps down through the drill string 12 where it exits through jets in the bit 11 and returns to the surface through the annulus 18 between the drill string 12 and the walls of the wellhole 10. As will be described in detail below, the drilling tool 20 is constructed and arranged to cause the drill bit 11 to drill along a curved path at a particular azimuth and establish a new inclination for the borehole even though the tool and bit are being rotated by the drill string 12 and the rotary table 13.

An MWD tool 19 preferably is connected in the drill string 12 between the upper end of the drilling tool 20 and the lower end of the pipe section 14'. The MWD tool 19 can be of the type shown in U.S. Pat. Nos. 4,100,528, 4,103,281 and 4,167,000 where a rotary valve on the upper end of a controller interrupts the mud flow in a manner such that pressure pulses representing downhole measurements are telemetered to the surface where they are detected by a pressure transducer and are processed and displayed and/or recorded. The MWD assembly usually is housed in a non-magnetic drill collar, and includes directional sensors such as orthogonally mounted accelerometers and magnetometers which respectively measure components of the earth's gravity and magnetic fields and produce output signals which are fed to a cartridge which is electrically connected to the controller. The mud flow also passes through a turbine which drives a generator that supplies electrical power to the system. The rotation of the valve is modulated by the controller in a manner such that the pressure pulses created thereby are representative of the measurements. Thus the downhole measurements are available at the surface substantially in real time as drilling proceeds. The above mentioned patents are incorporated herein by express reference.

Figure 2:
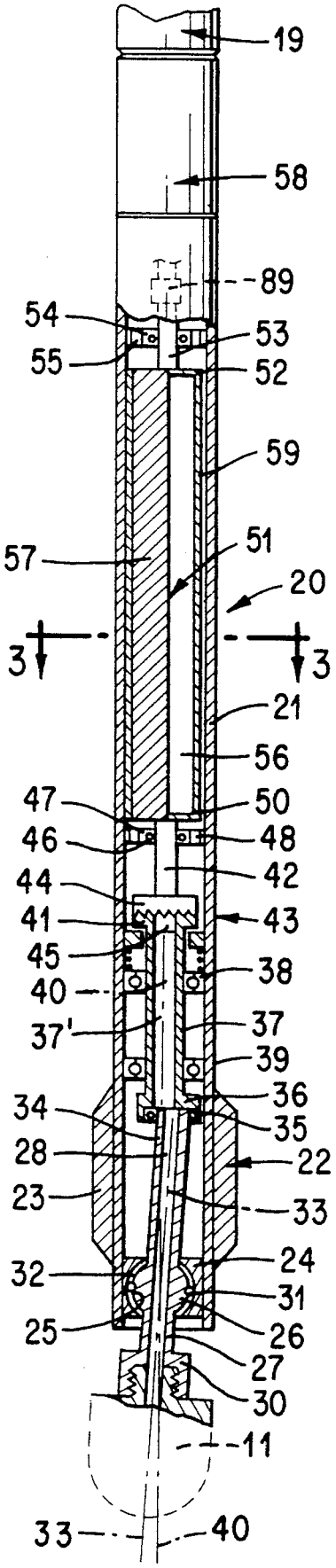
FIG. 2 is a longitudinal cross-sectional view, with some portions in side elevation, showing the overall construction of the drilling tool of the present invention.

The overall construction of the drilling tool 20 is shown in FIG. 2. An elongated tubular housing 21 carries a stabilizer 22 near its lower end, the stabilizer having a plurality of radially extending blades or ribs 23 whose outer arcuate faces are on substantially the same diameter as the gage diameter of the bit 11 so as to center the longitudinal axis of the housing 21 in the newly drilled borehole. One or more additional stabilizers (not shown) mounted further up the string also can be used. A transverse wall 24 at the lower end of the housing 21 has a central spherical cavity 25 that receives a ball 26 formed between the lower and upper ends of a drive shaft 27. The shaft 27 has an internal flow passage 28 which conveys drilling mud to the bit 11, and is secured to a bit box 30 at the lower end thereof. The shaft 27 is coupled to the wall 24 and thus to the housing 21 by a universal joint including a plurality of circumferentially spaced ball bearings 31 that engage in respective depressions in the outer surface of the ball 26 and in angularly spaced slots 32 in the walls of the cavity 25. Thus torque is transmitted from the housing 21 to the drive shaft 27 and the bit 11 via the ball bearings 31 and the slots 32. However, the shaft 27 and the bit 11, which have a common axis 33, are articulated and universally pivoted about the geometrical center of the coupling ball 26. The angle of pivotal rotation is fixed by the amount of eccentricity of a bearing 35 at the upper end of the shaft 27.

Figure 3:
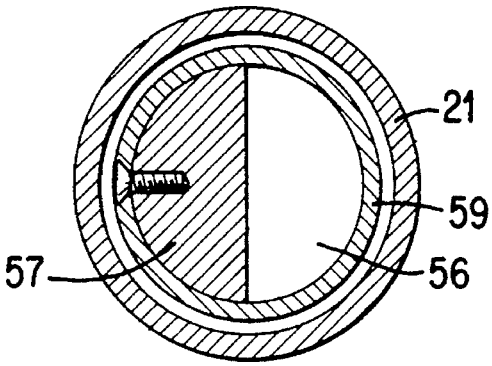
FIG. 3 is an enlarged cross-section on line 3—3 of FIG. 2.
Figure 5:
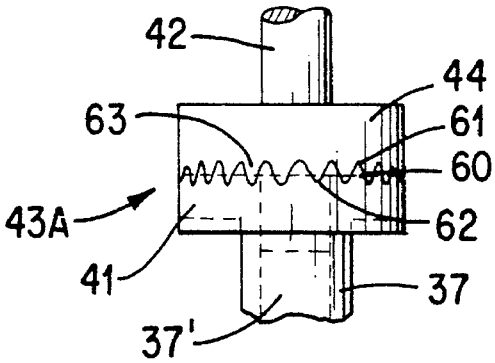
FIGS. 5 and 6 are fragmentary views illustrating additional details of the clutch structures.
Figure 4:
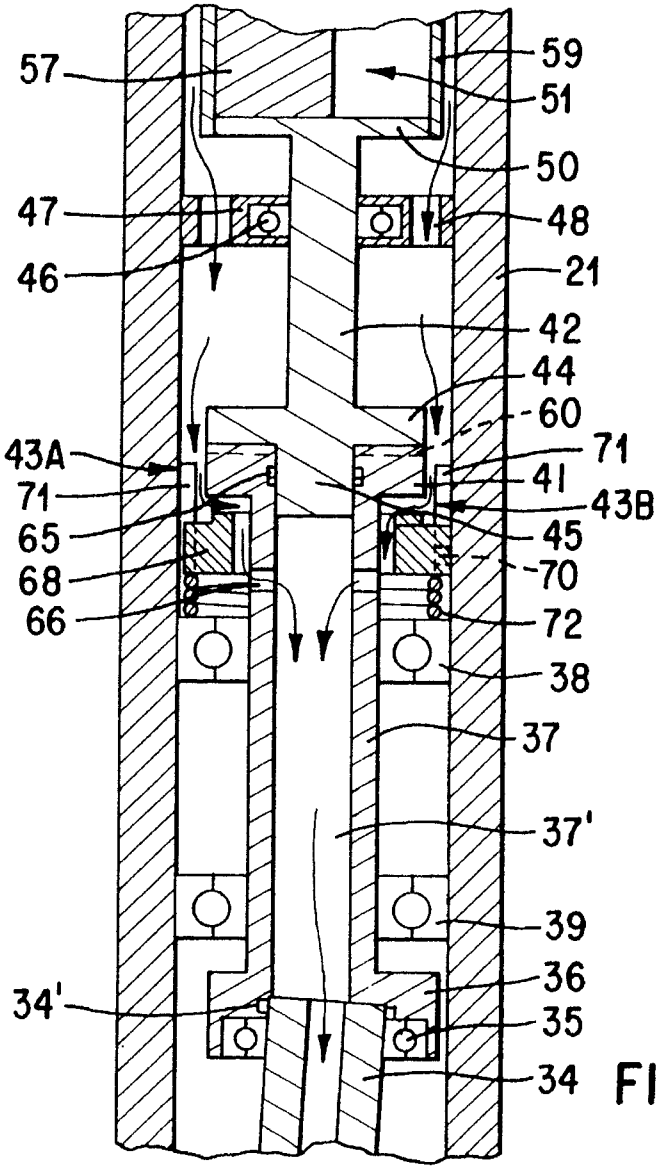
FIG. 4 is an enlarged cross-sectional view of the clutch system referred to above.

The upper end portion 34 of the drive shaft 27 is received in bearing 35 that is mounted in a recess in the enlarged and eccentrically arranged lower end portion or flange 36 of an intermediate shaft 37. Fluid leakage out of the upper end of the drive shaft 27 is prevented by a suitable seal ring 34' (FIG. 4). The intermediate shaft 37 has a central bore 37' that communicates with the flow passage 28 in the drive shaft 27, and is mounted for rotation within the housing 21 by axially spaced bearings 38, 39. The bearings 38, 39 also are arranged in a typical manner to fix the shaft 37 against axial movement. The upper end of the shaft 37 has an outwardly directed annular shoulder 41 that is releasably coupled to an upper shaft 42 by a clutch mechanism indicated generally at 43. The upper shaft 42 also has an outwardly directed annular shoulder 44 with clutch elements to be described below, and is provided with a valve head 45 that seats into the upper end portion of the shaft bore 37'. The shaft 42 extends upward through a bearing 46 that it is mounted in a transverse plate 47 having a plurality of flow passages 48, and is attached to the lower end wall 50 of an elongated eccentric weight indicated generally at 51. The upper end wall 52 of the weight 51 is fixed to a trunnion 53 that extends through an upper bearing assembly 54 having flow passages 55. The longitudinal axis of the weight 51 is coincident with the longitudinal axis 40 of the housing 21. The eccentric weight assembly 51 includes a cylindrical outer member 59 which, together with the end walls 50, 52, defines an internal cylindrical chamber 56 that receives an eccentric weight member 57. The weight 57 is in the form of an elongated, semicircular slab of a heavy metal material such as steel or lead as shown in FIG. 3. The weight 57 is fixed by suitable means to one side of the chamber 56 so that in an inclined borehole, gravity forces the weight member 57 to remain on the low side of the borehole and thus fix the rotational orientation of the weight assembly 51 in such position, even though the housing 21 is rotating around it. A telescoping joint connection 58, to be described below in connection with FIGS. 8–11, forms the upper end of the tool 20, and the upper end of such joint is connected to the lower end of the MWD tool 19.

The clutch mechanism 43 is illustrated in additional detail in FIGS. 4–7. The mechanism includes a first clutch 43A where the upper face of the annular shoulder 41 is provided with a plurality of angularly spaced undulations 60 (FIG. 5) having rounded peaks 61 and valleys 62. The lower face of the annular shoulder 44 has companion undulations 63 so that the clutch will engage in practically any relative rotational position of the shafts 37 and 42. As will be explained below, the upper shaft 42 and the weight assembly 51 can be shifted axially in the housing 21 to effect engagement and disengagement of the first clutch 43A. When the clutch 43A is engaged as shown in FIG. 4, the valve head 45 on the lower side of the shoulder 44 seats in the upper end portion of the bore 37' of the intermediate shaft 37 where a seal ring 65 prevents fluid leakage. In such position, drilling fluids or mud being pumped down through the housing 21 must go around the clutch shoulders 41, 44 and enter the bore 37' of the shaft 37 via a plurality of radial ports 66 through the walls of the shaft. However, when the valve head 45 is moved upward and out of its seat, drilling fluids can flow directly into the top of the bore 37' through an unrestricted flow area.

Figure 6:
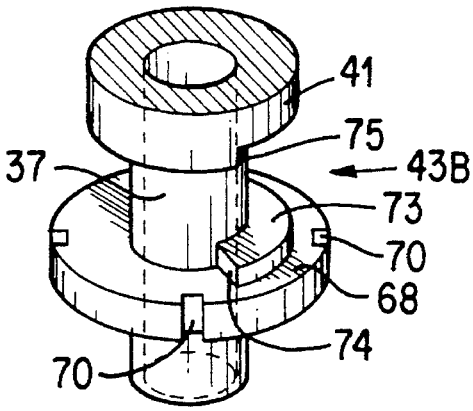

A second clutch indicated generally at 43B in FIGS. 4 and 6 also is provided. The clutch 43B includes an axially slidable ring 68 having external spline grooves 70 that mesh with internal spline ribs 71 on the inner wall of the housing 21, so that the ring can slide longitudinally but not rotate relative to the housing. The ring 68 is biased upward by a coil spring 72 (FIG. 7) that reacts between the lower side of the ring and the upper side of the bearing 38. The upper side of the ring 68 has a semi-circular raised portion 73 providing diametrically opposed, radial faces 74, and the lower side of the shoulder 41 on the upper end of the shaft 37 is formed with the same arrangement of radial faces, one being shown at 75 in FIG. 6. Thus arranged, the faces 74, 75 can engage one another in only one relative rotational position of the ring 68 and the shoulder 41. The relative flow areas through the side ports 66 and the bore 37' are sized such that when the valve head 45 is seated in the top of the bore 37', flow of drilling fluids past the shoulders 41, 44 and into the ports 66, as shown by the arrows in FIG. 4, forces the ring 68 to shift downward against the bias of the spring 72 so that the clutch faces 74, 75 are disengaged. If fluid flow is stopped, the spring 72 shifts the ring 68 upward to engage the clutch when the faces 74, 75 are properly aligned. Engagement of both clutches 43A and 43B locks the eccentric weight 57 so it will turn with the housing 21. When the clutch 43A is disengaged by upward movement of the shaft 42, the clutch 43B will remain engaged even when circulation is initiated because all the mud flow will go directly into the top of bore 37' and there are insufficient flow forces tending to cause collapse of the spring 72. Engagement of the clutch 43B locks the intermediate shaft 37 to the housing 21 so that the axis 33 of the bit 11 (toolface) can be oriented by slowly turning the drill string 12 at the surface while operating the MWD tool 19 to observe the azimuth of such axis.

FIGS. 8–11 show a telescoping joint 58 of the type that can be included at the upper end of the housing 21 to enable shifting the weight assembly 51 and the shaft 42 axially in order to operate the clutch 43A and the valve head 45 in response to manipulation of the drill string 12 at the surface. The upper end of the housing 21 has an inwardly directed stop shoulder 80 and internal longitudinal splines 81 which extend downward from the shoulder. A collar 82 which is connected by threads (not shown) to the lower end of the MWD tool 19 has a reduced diameter portion 84 as its lower end that extends down inside the shoulder 80 to where it has an enlarged lower end portion 85 with external grooves that mesh with the splines 81 to prevent relative rotation. Thus the collar 82 can move upward until the end portion 85 engages the shoulder 80, and downward until its lower surface 86 (FIG. 9) abuts the top of the housing 21. A seal ring 87 prevents leakage of drilling fluids. The upper end of the trunnion 53 on the eccentric weight assembly 51 is rotatably mounted by a bearing assembly 89 on the lower end of a rod 88 whose upper end is fixed to a transverse wall 90 at the upper end of the collar 82. The wall 90 is provided with several flow ports 91 as shown, so that drilling fluids can pass downwardly therethrough.

A sleeve 92, which can be an integral part of the housing 21, has a plurality of circumferentially spaced, upwardly extending spring fingers 93 formed on its upper end, and each of the fingers has an enlarged head portion 94. Upper and lower internal annular grooves 95, 96 are formed inside a reduced diameter bore 97 of the collar 82 and cooperate with the heads 94 to latch the collar 82 to the housing 21 in selected longitudinal relative positions. In order to lock the heads 94 in a groove 95 or 96, a piston 98 having a greater diameter portion 99 and a lesser diameter portion 100 is slidably received in an internal bore 101 in the collar 82 and is biased upwardly by a coil spring 102 that reacts between the lower face of the portion 99 and an upwardly facing shoulder 103 on the collar 82. A seal ring 105 can be mounted on portion 99 of the piston 98 to prevent leakage past its outer walls. The piston 98 has a central bore 104 through which the rod 88 extends, and the annular area between the wall of the bore and the outer periphery of the rod provides a flow passage having a restricted area. The outer diameter of the lower portion 100 of the piston 98 is sized to fit within the spring fingers 93 only when the heads 94 have resiled into a groove 95 or 96. Fluid flow through the restricted annular area forces the piston 98 downward against the bias of the coil spring 102 and causes the lower portion 100 to move behind the heads 94 and thereby lock them in a groove 95 or 96 so that the collar 82, the rod 88 and the trunnion 53 are fixed longitudinally relative to the housing 21. This also fixes the longitudinal position of the weight 57 relative to the housing 21.

Figure 7:
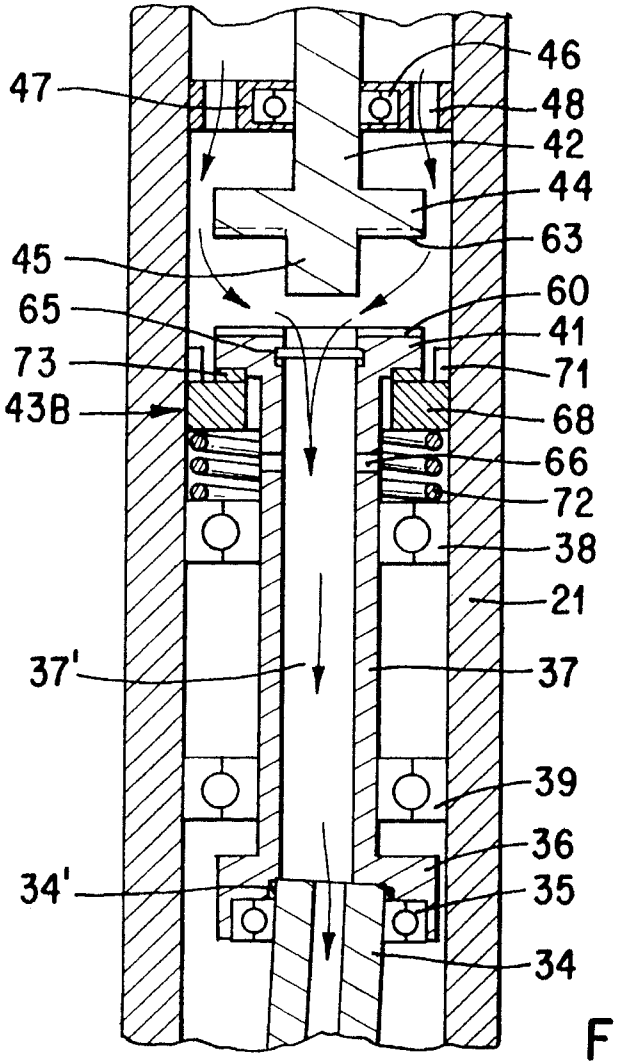
FIG. 7 is a view similar to FIG. 4 showing one clutch disengaged and with unrestricted flow through the intermediate shaft.
Figure 9:
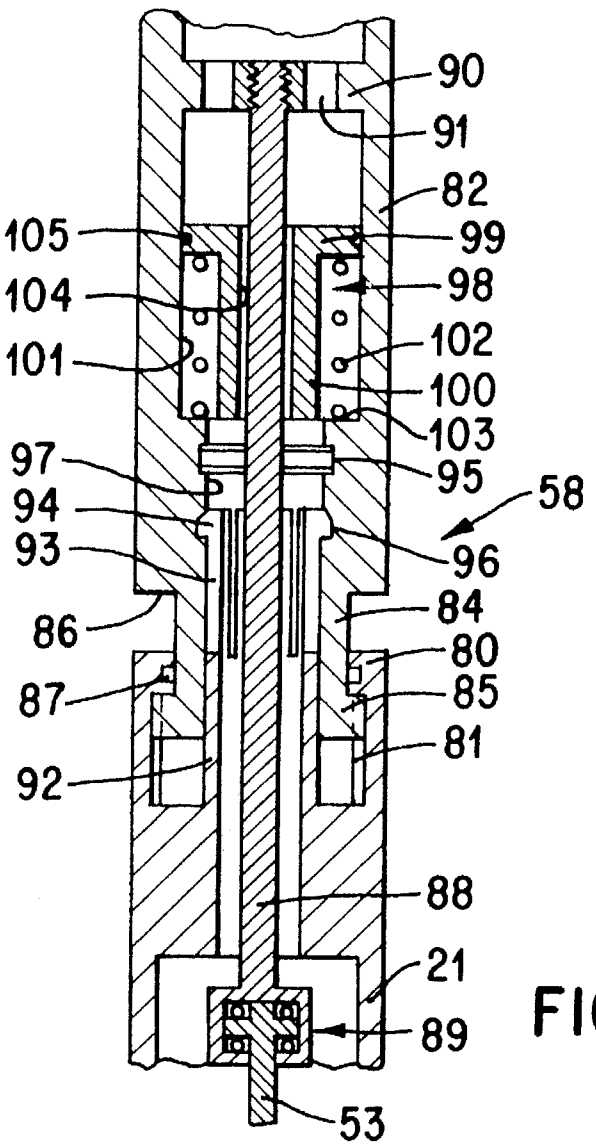
FIGS. 8–11 are cross-sectional views showing the various operating positions of a telescoping or slip joint connection that can be used to selectively disengage one of the clutches shown in FIG. 4.
Figure 8:
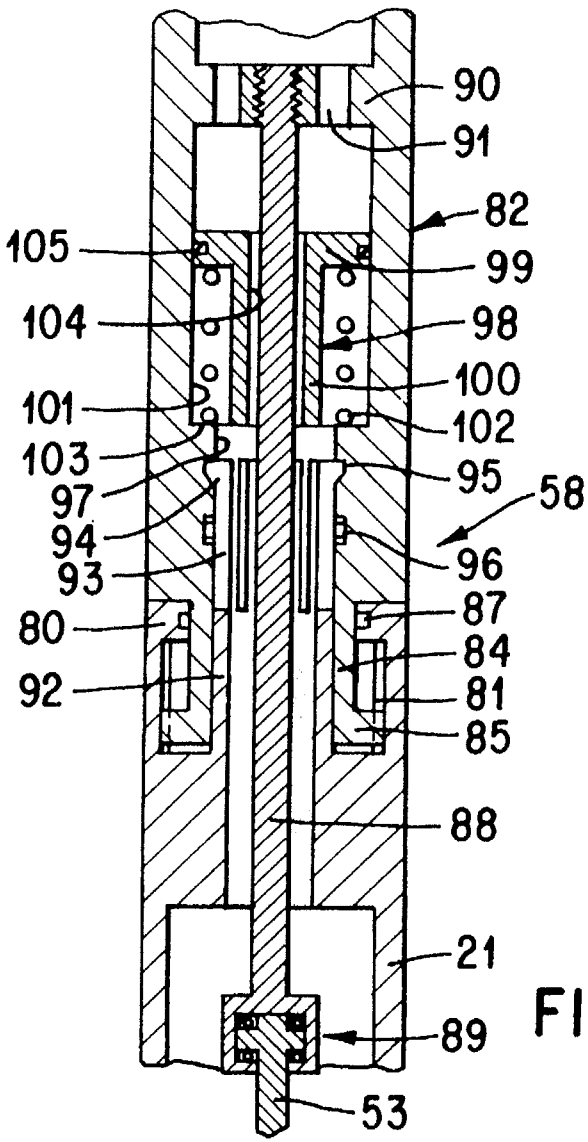
Figure 11:
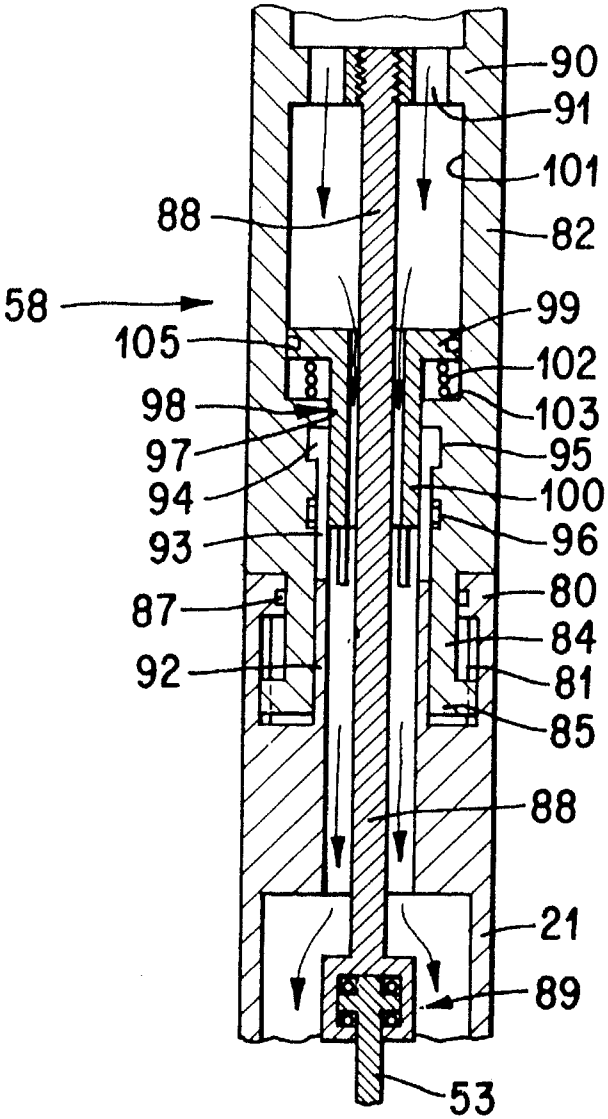
Figure 10:
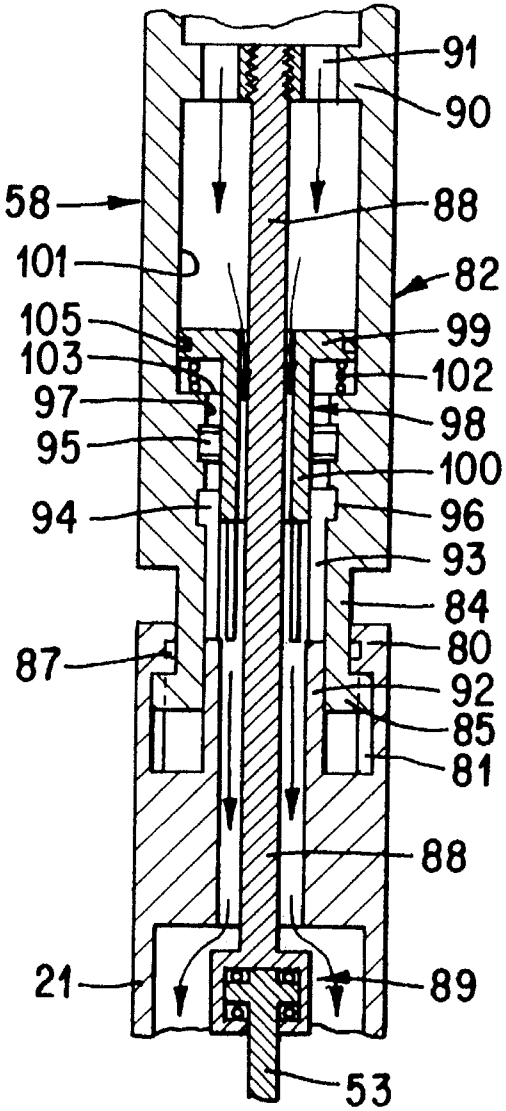

FIG. 8 shows the no-flow and unlocked position of the parts of the telescoping joint 58 when the drilling tool 2 1 is on bottom and the joint collapsed or retracted. In the absence of fluid flow, the piston 98 is lifted upward by the spring 102. The latch heads 94 are in the groove 95 due to joint contraction, however they are not locked in their outer positions by the piston 98. In FIG. 9 the tool 20 has been picked up off bottom to extend the joint 58 and thus lift the rod 88 and the trunnion 53, which lifts the weight 57 within the housing 21 to disengage the clutch 43A as shown in FIG. 7. However, the piston 98 remains in its upper position in the absence of fluid flow. In FIG. 10 drilling fluid is being pumped downward through the tool 20 so that the pressure drop due to fluid flow through the restricted bore area of the piston 98 forces it downward against the bias of the spring 102 to position the lower portion 100 behind the latch heads 94 and thus lock the collar 82, the rod 88 and the trunnion 53 to the housing 21. The clutch 43A remains disengaged since the weight 57 is lifted upward, but the spring 72 engages the clutch 43B to lock the intermediate shaft 37 to the housing 21. This allows reorienting the toolface of the bit 11 by turning the drill string 12 at the surface and observing the display provided by MWD signals. If drilling is commenced with the telescoping joint 58 in the extended position, the bit 11 will tend to drill straight ahead because the drive shaft 27 is fixed to the housing 21 and its upper end 34 will merely orbit about the longitudinal axis 40 of the housing 21 as the latter is rotated by the drill string 12. In FIG. 11 the pumps have been stopped and the tool 20 lowered to bottom to cause the joint 58 to retract, which is done after reorienting as described above. Then the mud pumps are restarted to commence drilling, which causes the piston 98 to shift down as shown and lock the latch heads 94 in the upper groove 95. As the joint 58 was collapsed, the trunnion 53 was lowered to correspondingly lower the eccentric weight 57 and engage the clutch 43A. With the valve head 45 seated in the upper end of the shaft 37, fluid flows past the clutch ring 68 as shown in FIG. 4 and forces it downward to its released position where the weight 57, the intermediate shaft 37 and the drive shaft 27 remain fixed in space as the housing 21 revolves around them.

OPERATION

In use and operation of the present invention, the drilling tool 20 having the bit 11 attached to the lower end of the drive shaft 27 is connected to the lower end of the MWD tool 19 and lowered into the wellbore 10 on the end of the drill string 12 as its individual sections or joints are threaded end-to-end. During lowering the telescoping joint 58 will be extended, however, since there is no circulation the piston 98 will be in its upper position shown in FIG. 9, and the heads 94 of the spring fingers 93 will be in the lower groove 96. When the tool 20 reaches the bottom the joint 58 is collapsed and causes the clutch 43A to engage. When circulation is started the clutch 43B will disengage to allow the weight 57 to hold the drive shaft 27 stationary in space as the housing 21 and bit 11 are rotated. The toolface of the bit 11 will have been oriented as described above by initially picking up to extend the telescoping joint 58 and thereby release the clutch 43A, and then starting the pumps to lock the joint 58. The clutch 43B engages to lock the shafts 37 and 27 to the housing 21, so that the housing can be turned to orient the toolface. Fluid circulation operates the MWD tool 19 so that inclination, azimuth and toolface angles are displayed at the surface in real time. The piston 98 moves down to the locked position shown in FIG. 11.

To change the initial toolface angle setting if the need arises, circulation is stopped, and the drill string 12 is picked up a short distance to extend the telescoping joint 58 as shown in FIG. 9. This lifts the eccentric weight 57 and disengages the clutch assembly 43A as shown in FIG. 7, and also lifts the valve head 45 out of its seat in the upper end of the shaft 37. Circulation then is resumed to operate the MWD tool 19, which causes the piston 98 to shift down and lock the heads 94. The clutch 43B remains engaged as shown in FIG. 7 due to unrestricted flow into the top of the bore 37' of the shaft 37. The shaft 37 and the eccentric bearing 35 are thus locked to the housing 21 by the clutch ring 68 and the splines 71 so that the rotation axis 33 (FIG. 2) of the bit 11 is fixed relative to the housing 21. Then the drill string 12 is slowly turned until the toolface, which is the heading of the axis 33, has the desired value as shown by the MWD display at the surface. During such turning the weight 57 remains on the low side of the wellbore 10 due to gravity. Then the pumps are stopped and the tool 20 is lowered to bottom. Some of the weight of the drill collars 15 is slacked off thereon to collapse the joint 58 as shown in FIG. 8. This movement lowers the weight 57 to cause the clutch 43A to engage, and seats the valve head 45 in the top of the bore 37'. Then mud circulation is resumed and must go around the clutch 43A and into the ports 66, which causes the ring 68 to shift down and cause disengagement of the faces 74, 75 of clutch 43B as shown in FIG. 4. Now the housing 21 can rotate freely relative to the intermediate shaft 37, which is held stationary in space by the tendency of the weight 57 to remain adjacent the low side of the inclined portion 17 of the wellbore 10. Thus the eccentric bearing 35 is spatially fixed so that as the bit 11 is rotated by the housing 21 via the ball joint 26, the orientation of the axis 33 remains fixed and pointed in the same direction in space. The wellbore 10 will be drilled along a curved path on account of the angle between the axis 33 and the longitudinal axis 40 of the housing 21. A bearing recess in the flange 36 of the shaft 37 having a particular amount of eccentricity can be provided during assembly at the surface to achieve a desired radius of curvature of the lower portion 17 of the wellbore 10. For example, an eccentricity can be chosen such that the acute angle between the axis 40 of the housing 21 and the rotation axis 33 of the bit 11 is in the range of from about 1°–3°. As the bit 11 is rotated by the housing 21 in response to rotation of the drill string 12, gravity causes the eccentric weight 57 to remain stationary adjacent the low side of the wellbore 10 as the housing 21 rotates around it. The ball joint 26 which mounts the drive shaft 27 at the lower end of the housing 21 allows the shaft to articulate about the center of the ball. When re-orienting the toolface angle as described above, the mud pumps are stopped to cause engagement of the clutch 43B. Since the clutch can engage in only one relative position as previously noted, the drill string 12 should be rotated slowly through several turns without pumping to ensure engagement. When such engagement occurs, the intermediate shaft 37 again is locked to the housing 21 via the splines 70, 71 with the axis 33 of the bit 11 having a known relative orientation.

It now will be recognized that a new and improved steerable drilling tool for drilling directional wells has been disclosed which is operated by rotation of the drill string, and which is particularly useful in combination with an MWD tool. Since certain changes or modifications may be made in the disclosed embodiment without departing from the inventive concepts involved, it is the aim of the appended claims to cover all such changes and modifications falling within the true spirit and scope of the present invention.

What is claimed is:

1. A method of drilling a directional borehole with a drill bit mounted on the lower end of a rotary drill string by an articulated drive shaft, said drill string having a first axis of rotation and said drive shaft and bit having a second axis of rotation, comprising the steps of: transmitting torque from said drill string to said drive shaft and bit with said second axis intersecting said first axis at a low angle so that said borehole is drilled on a curved trajectory; and employing gravity to maintain said second axis pointed in one direction in space during rotation of said bit by said drill string.

2. The method of claim 1 wherein said employing step includes mounting an eccentric weight in said drill string in a manner such that said weight remains on the low side of said borehole during rotation of said drill string; and coupling said weight to said drive shaft in a manner to maintain said second axis in said one direction during rotation of said drill string.

3. The method of claim 2 including the further step of uncoupling said weight from said drive shaft; reorienting said second axis so that it points in a different direction in space; and recoupling said weight to said drive shaft to allow drilling with a different toolface.

4. The method of claim 1 including the further steps of making downhole measurements of the-azimuth of said one direction; and transmitting signals representing such measurements to the surface to allow monitoring the progress of said drilling.

* * * * *